United States Patent [19]

Andersson

[11] 4,250,693

[45] Feb. 17, 1981

[54] APPARATUS FOR PACKING UNITS OF GOODS UNDER CONTINUOUS MOVEMENT

[75] Inventor: Nils E. Andersson, Orebro, Sweden

[73] Assignee: Sundpacma Aktiebolag, Malmo, Sweden

[21] Appl. No.: 858,427

[22] Filed: Dec. 7, 1977

[30] Foreign Application Priority Data

Dec. 7, 1976 [SE] Sweden ..... 7613752

[51] Int. Cl.³ ..... B65B 35/44; B65B 11/12

[52] U.S. Cl. ..... 53/543; 53/579; 53/207

[58] Field of Search ..... 53/26, 29, 48, 159, 53/164, 183, 186, 195, 252, 284, 452, 462, 578, 579, 443, 207, 543; 198/425, 461

[56] References Cited

U.S. PATENT DOCUMENTS

| | | | |
|---|---|---|---|
| 2,873,565 | 2/1959 | Arneson | 53/48 X |
| 2,907,155 | 10/1959 | Engleson et al. | 53/252 X |
| 2,997,830 | 8/1961 | Nelson | 53/579 X |
| 3,155,221 | 11/1964 | Griner | 198/461 X |
| 3,225,510 | 12/1965 | Jones et al. | 53/186 X |
| 3,300,947 | 1/1967 | Fahrenbach | 53/186 |
| 3,555,776 | 1/1971 | Nigrelli et al. | 53/207 X |
| 3,771,282 | 11/1973 | Flanagan | 53/578 X |

*Primary Examiner*—Travis S. McGehee

*Attorney, Agent, or Firm*—James C. Wray

[57] ABSTRACT

Goods to be packed are continuously collected in units of goods. Parallelly therewith plain package blanks are preformed to package containers, which are completely open at least at one vertical side. The units of goods and the open package containers are moved in a continuous feeding movement side by side with the same speed, and with the open container side facing the unit of goods. During the feeding movement a unit of goods is pushed sideways into a package container. The open container side or sides are closed and sealed, and the package is moved away from the packaging station. The front side and the rear side of the preformed package container as considered in the feeding direction are widened in relation to each other before the units of goods are pushed into the containers to facilitate the pushing in of the units of goods into the package containers. The front side and the rear side are strongly pressed into contact with the unit of goods and are secured in the strongly pressed position by sealing the remaining sides of the container.

15 Claims, 5 Drawing Figures

APPARATUS FOR PACKING UNITS OF GOODS UNDER CONTINUOUS MOVEMENT

Figure 1:
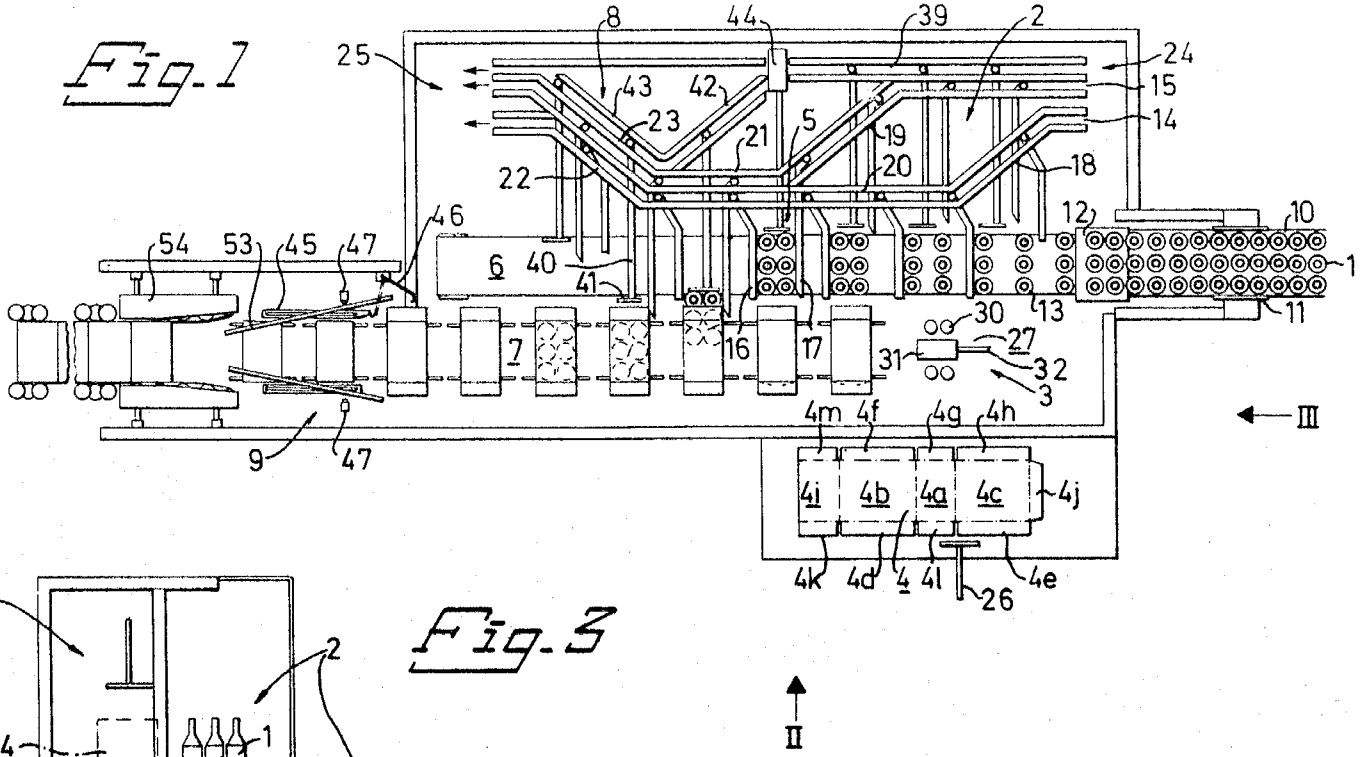

The present invention relates to a method and an apparatus for packing units of goods under continuous movement in wrap-around packages, whereby the package is successively wrapped round the unit of goods and is thereafter sealed. According to conventional methods goods are generally packed by being moved down into a package container which is at least partly closed, whereupon the part thereof which was previously not closed, generally the lid, is closed and the package is sealed. This method of packing goods generally necessitates a substantial amount of manual work or complicated and expensive machines to lift and move the goods to be packed into the container, and also in case of moving the goods into the container and closing and sealing the lid thereof the method is relatively time consuming. It is also difficult in the said method to pack the goods so compact that it cannot move within the package, and when packing fragile or otherwise brittle goods like bottles etc. it is therefore generally necessary to provide protecting spacers between the packed pieces of goods.

In many cases units of goods are therefore nowadays packed in so called "wrap-around-packages" which method includes putting the unit of goods which includes several parts on a plain package blank and subsequently the said package blank is successively held up or is wrapped around the unit of goods and is sealed. The said method makes it possible to substantially increase the speed of packing goods as compared with the previously known method, and the goods is packed much more compact so that the goods is kept quite immovable in the package, and even when packing fragile or brittle goods it is generally not necessary to use protecting spacers or similar means.

In a previously known method of providing wrap-around-packages the pieces to be packed are collected to units of goods, and the said units are put on a plain punched package blank, whereafter at least some sides of the package blank are fold up to the sides of the unit of goods, generally by pulling the blank and the goods-unit downwards between fold rails or fold rollers, whereafter the remaining sides and the package lid are successively closed and sealed. The method can be executed by collecting the goods-unit aside of the package blank and by pushing the goods-unit over to the bottom portion of the said package blank, whereafter the blank together with the goods-unit is pulled down between folding-up-rails, and when the goods-unit is thereby kept together by the package blank at least from two opposite sides the package together with the goods-unit is pushed over to a conveyor, on which the remaining sides and the lid of the package are successively or stepwise closed and sealed.

The said method and apparatus is particularly suitable when packing continuously manufactured goods of any kind like canned goods, bottles etc. Thereby the goods is generally fed under continuous movement on a conveyor towards the unit for providing the wrap-around-package. In the said previously known method however special means have to be provided to prevent the goods from being fed while at least some of the sides of the package are fold up along the unit of goods, which step is carried through without any horizontal movement of the package blank and the unit of goods. The said step therefore generally involves an interrupting of the feeding of manufactured goods which both necessitates a very stable construction of the apparatus in order to withstand the intermittent brakings and startings respectively, and the said intermittent feeding involves an obvious risk of break down due to the successive brakings and startings and that the method is relatively slow as compared with packing under continuous feeding operation.

Basis of the invention therefore is the problem to provide a method and an apparatus for packing units of goods in so called wrap-around-packages under continuous movement of the manufactured goods and in which the said goods still under movement can be collected to units and pushed over onto a package blank which during movement is closed and sealed.

The method according to the invention means that the goods to be packed is continuously collected to units of goods, and concurrently therewith plain package blanks are formed to package containers which are completely open at least at one vertical side, whereafter the units of goods and the package containers are moved under continuous movment side by side with the same speed and each with an open container side facing the unit of goods, and during the said feeding movement the unit of goods is laterally pushed into the package container whereupon the open container side or sides are closed and the package is sealed and is moved away from the package station.

To give a better understanding the invention will in the following be described more in detail with reference to the accompanying drawings which illustrate an embodiment of an apparatus for executing the method. It is however to be understood that the described and shown embodiment of the invention only is an illustrating example and that the invention is not restricted to the said embodiment and that all kinds of modifications may be present within the scope of the appended claims.

Figure 3:
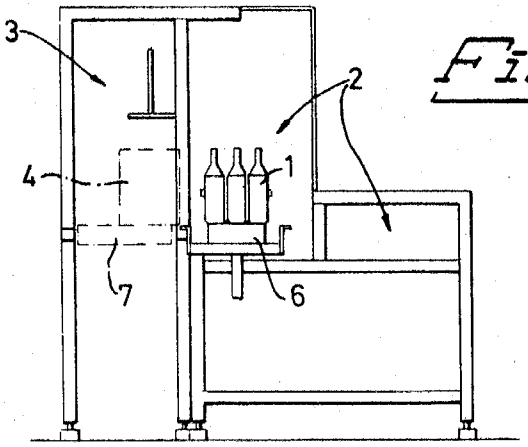
Figure 2:
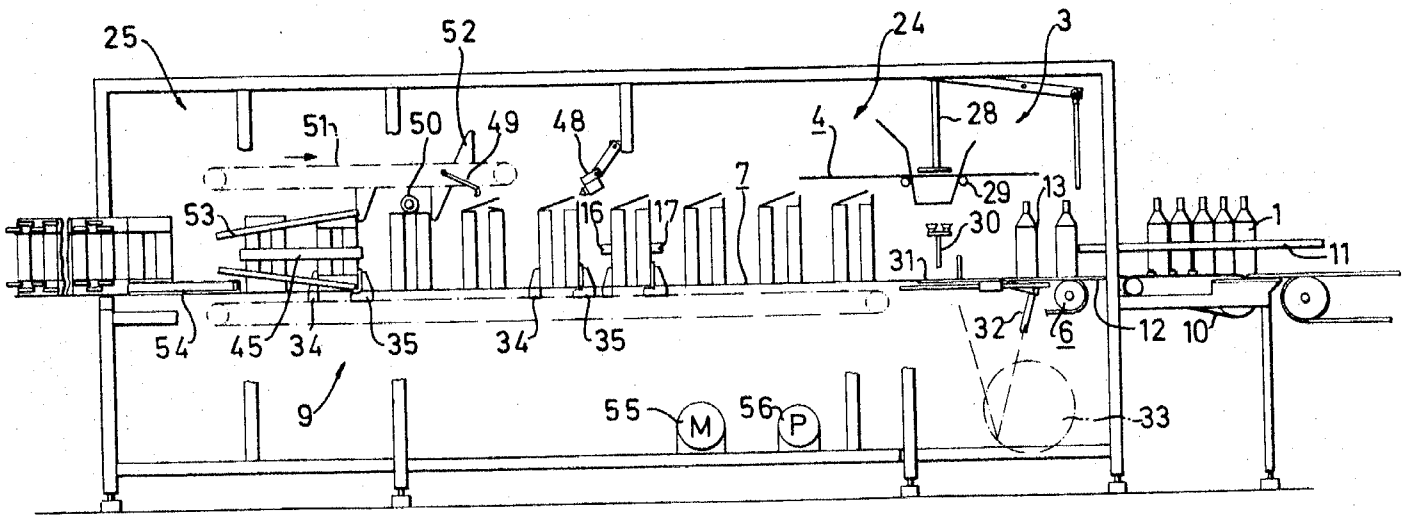
Figure 4:
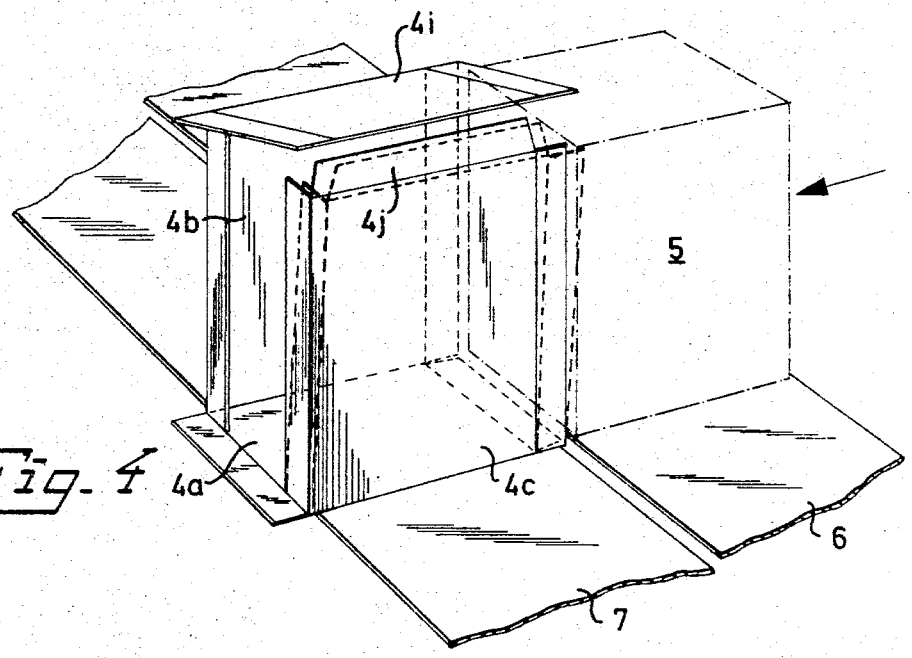
Figure 5:
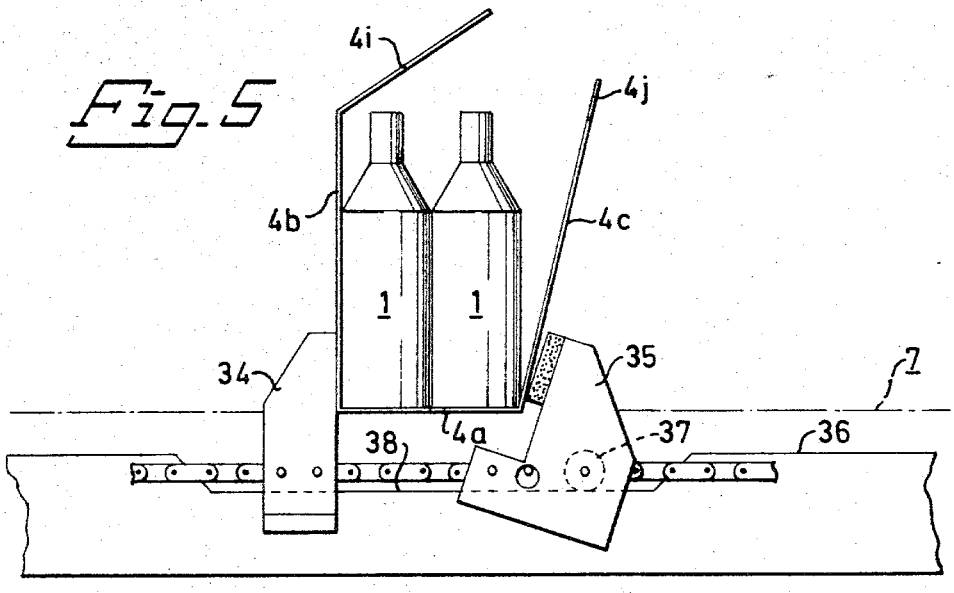

In the drawings:

FIG. 1 is a top plan view diagrammatically showing an apparatus for executing the method according to invention, FIG. 2 is a side view of the apparatus according to FIG. 1 seen along the arrow II, FIG. 3 is an end view of the apparatus of FIG. 1 seen along the arrow III, FIG. 4 shows a package blank which is prepared for receiving units of goods, and FIG. 5 shows a detail of the apparatus.

The apparatus shown in the drawings is meant for packing of goods like bottles 1 which are continuously fed from a manufacturing and filling unit (not shown in the drawings). Generally the apparatus according to the invention comprises a unit 2 for collecting goods to units of goods, a means 3 for preparing a plain package blank 4 to receive corrected units of goods 5, a means 6 for continuously feeding the units of goods, a means 7 for continuously feeding the prepared packages or containers, a means 8 for pushing the unit of goods into the prepared package and a means 9 for closing and sealing the package.

The bottles 1 received from the manufacture and filling machine are moved on a conveyor 10 which moves at a predetermined speed and during said movement they are guided by side bars 11, in the illustrated case with three bottles aside of each other. From the conveyor 10 the bottles are pushed over onto a transfer plate 12 depending on the pressure from the bottles behind, and from the said transfer plate they are moved over to the feeder 6 for units of goods which feeder is likewise a conveyor belt moving at somewhat higher speed than the conveyor belt 10. Depending on the speed difference between the two conveyor belts 10 and 6 the rows 13 of bottles are somewhat separated from each other what is necessary to enable a collecting of goods to units of goods.

The apparatus 2 for collecting the rows 13 of bottles into units comprises two guides 14 and 15 each including two rails which guide therebetween chains which support on an even distance from each other stop bars for the rows of bottles. Thus the guide 14 carries stop bars 16 for the front row of bottles of the goods-unit and the guide 15 carries stop bars 17 for the rearmost row of bottles for the goods-unit. The guides 14 and 15 are provided aside of the conveyor belt 6 and they are formed with obliquely extending inlet portions 18 and 19 respectively, a holder portion 20 and 21 respectively extending parallel to the transport conveyor and an outlet portion 22 and 23 respectively extending obliquely. The guides 14 and 15 and the stop bars 16 and 17 are provided horizontally and the bars 16 and 17 are preferably formed as bars or discs which in their movements from the inlet end 24 to the outlet end 25 carry through three different movements, viz. a pulling-in movement and concurrently therewith a longitudinal movement at the inlet portions 18 and 19 respectively, a straight longitudinal movement in the holder portions 20 and 21 respectively and a pulling out movement and concurrently therewith a longitudinal movement at the outlet portions 22 and 23 respectively. As mentioned the stop bars 16 and 17 are mounted in an endless chain (not shown) which from the outlet end 25 returns to the inlet end 24 at the underside or the rear side of the collecting unit 2. The inlet portions 18 and 19 and the outlet portions 22 and 23 extend as far in the transversal direction from the conveyor 6 for the goods-unit as is necessary so that the stop bars 16 and 17 at the inlet end 24 and the outlet end 25 are located completely outside the conveyor 6, whereby the rows 13 of bottles can move to a special front stop bar 16 without being prevented by the following front stop bar or any of the rear stop bars. The feeder chain for the rear stop bars 17 are preferably adjustable in relation to the feeder chain for the front stop bars 16 so that the rear stop bars 17 can be adjusted to any suitable distance from the front stop bars 16, and the said distance has to be such that the goods-units 5 are kept together to a compact unit by the front and the rear stop bars.

The means 3 for preparing the package blank 4 to receive a goods-unit 5 comprises a magazine (not shown) for package blanks 4 which is mounted above and aside of the feeder 7 for packages, and from the said magazine the top package blank 4 is pushed over to a formation unit 27 by a diagrammatically illustrated feeder 26. The formation unit 27 comprises a push-down means 28, two or several formation rollers or bars 29 and a pull-down means 30. Both the push-down means 28 and the pull-down means 30 are mounted vertically movable, whereas the formation rollers or bars 29 are mounted stationary. The pull-down means 30, which is preferably two vacuum discs, are mounted on each side of a table 31 onto which the bottom 4*a* of the package blank is pulled down from the magazine. The table 31 extends on the same level as the feeder 7 and it is connected to a pusher means 32 which pushes the package blank over to the feeder 7 after it is pulled down and is in part formed to a closed package. The formation rollers 29 are so located in relation to the push-down means 28 and the pull-down means 30 that the package sides 4*b* and 4*c* are fold up to substantially right angles to the package bottom 4*a* during this operation. The push-down means 28, the pull-down means 30 and the pusher 32 are connected to a common guide curve 33 which in a way known per se provides the intended movements which are related to each other and to the feeding of units 5 of goods. Thus the pusher 32 is guided so that a package blank which is pulled down is pushed over to the feeder 7 so as to lie exactly laterally related to the unit 5 of goods. The feeder 7 moves with exactly the same speed as the stop bars 16 and 17, as is necessary to make it possible to push the unit of goods into the package container under continuous movement.

For this purpose the feeder 7 is provided with spaced followers comprising a fixed front follower part 34 and a rear follower part 35 which is rotatable through some angle and which is guided by a curve 36 by means of a guide roller 37. The guide curve 36 is fixed and at a predetermined position it is formed with a stepped part 38 extending over the length of the feeder at which the unit 5 of goods is to be pushed into the package container. The purpose thereof is that the package container shall open to a slightly upwards diverging angle so that the unit of goods can be more easily pushed into the container and so that the rear package container side 4*c* after the goods-unit 5 is pushed in can be strongly pressed to the unit of goods while said unit at the front side is kept fixed by the fixed follower part 34. The said compressing is provided in that the guide roller 37 moves up to the raised portion of the curve 36. The feeder 7 is like the feeder 6 an endless belt and the follower parts 34 and 35 are moved back to the inlet end at the underside of the feeder 7. For the sake of clarity only three pairs of feeder parts 34, 35 have been indicated in FIG. 2, but it is to be understood that the feeder 7 contains a pair of feeder parts for each package container.

To provide a pushing in of the goods-unit 5 into the prepared package container there is a pusher comprising a guide 39 for instance consisting of a pair of rails and an endless chain extending between said rails and pushers 40 mounted at predetermined distances from each other on said chain. The distance between the pushers shall be exactly the same as the distance between the front stop bars 16 and the pusher is formed with a pusher plate 41 each one located exactly in front of a goods-unit 5. The guide 39, which is preferably provided aside of the guides 14 and 15 likewise comprises an inlet portion 42 directly followed by an outlet portion 43. During the movement along the said portions the pusher 40 pushes a goods-unit into the intended package container 4. The pusher 40 is that long and the portions 42, 43 of the guide 39 are so formed that the goods-unit is completely pushed in at the limit between the two portions 42, 43, whereupon the pusher is immediately moved out of the container 4. From the outlet end 25 the pusher is moved back to the inlet end 23 by its endless chain.

To prevent the pusher from making a pusher movement in case there is no unit of goods on the feeder 6 there is a diagrammatically indicated siding 44 which is thereby moved in towards the feeders 6 and 7 whereby the pushers 40 are moved straight forward instead of being guided over to the inlet portion 42.

The rails or rollers 29 of the blank preparation unit 3 are as mentioned above intended to fold the package container sides 4*b*, 4*c* upwards from the bottom side 4*a* thereof. The apparatus may also contain rollers or bars for folding the edges 4*d* and 4*e* located opposite to the feeder side towards each other. It is however of importance that the edges or sides 4*f*, 4*g*, 4*h* facing the units 5 of goods are completely open so that the unit of goods may easily be pushed into the container. For closing and sealing the said edges 4*b–h* and the lid 4*i* and the lid flap 4*j* means known per se are provided. For folding the side edge 4*f* in and if necessary folding the side edge 4*d* in there are a pair of bars 45, and for folding the rear side edge or side edges 4*h* and 4*e* respectively (seen in the moving direction) there is one or more rotatable arms 46 which push the said edges forwardly so as to be located between the bars 45. At the bars 45 there is one or more glue devices spraying glue onto the side edges 4*d*, *e*, *f* and *h* for making the remaining side edges 4*k*, *l*, *m* and *g* stick thereto. Before doing this the lid 4*i* is glued in that a glue device 48 mounted in a suitable position above the feeder 7 sprays glue onto the lid flap 4*j*, and a rotatable pivot arm 49 hits the lid flap and pushes said flap forwards whereupon a stationary press roller 50 presses the lid 4*i* down so that the lid is attached to the lid flap 4*j*. The pivot arm 49 is mounted on an endless chain 51 provided at a suitable distance above the feeder 7, and rear followers 52 are mounted equally spaces on said endless chain. The said rear followers 52 swings down to the rear side of the container 4 thereby providing a support for said container so that the press roller 50 can press also the upper side of the container to a very tight and compact unit. Thus the lid is attached before or concurrently with folding the side edges 4*d*, *e*, *f*, *h* in to each other guided by obliquely extending bars 53 and they are attached to the edges 4*d*, *e*, *f* and *h* which are supplied with glue. The package thereby provided is by a feeder 54 moved out from the feeder 7 and away from the packaging machine.

The apparatus for executing the method according to the invention is above described and illustrated diagrammatically and it is for any expert obvious how the said diagrammatically illustrated parts can be realized. Thus the feeder 6 and 7 may like the feeder of the pivot arms 46 and 49, the push-down means 28, the pusher 32 and the chains of the guides 14, 15 and 39 be connected to a common drive motor 55, and the suction plates of the pull-down means 30 may be connected to the suction portion of an intermittently working pump 56 which provides a suction action during the very pull-down movement of the container but releases the said pump action as soon as the container is standing on the table 31. Likewise the glue devices 47 and 48 may be connected to a suitable source of air-pressure or any other means for providing an ejection of glue.

What is claimed:

1. Apparatus for executing the method for packing of unit of goods (5) in so called wrap-around-packages under continuous movement, whereby the package (4) is successively wrapped around the unit of goods and is sealed, characterized in that the apparatus generally comprises means (2) for continuously collecting units (5) of goods to be packed, means (3) for formation of a plain package blank (4) to a package container with one sloped wall, which is completely open at least at one side, means (6, 16, 17, 7, 34, 35) for continuously feeding units (5) of goods and the preformed package containers (4) in a continuous movement with the same speed and side by side, means (8) for pushing each of the units (5) of goods into one package container (4), and means (9) for closing and sealing the package containers (4) which are filled with units (5) of goods further characterized in that means for continuously collecting units (5) of goods (1) comprises a conveyor (1) for continuously feeding the goods (1), a second conveyor (7) moving with a higher speed than the first mentioned conveyor (10) and onto which the goods is one by one pushed from the first mentioned conveyor (10), whereby the pieces (1) of goods are separated from each other in the moving direction, and the said means comprises at least one stop bar (16) moving at higher speed than the first mentioned conveyor (10), which stop bar (16) reduces the speed of the pieces of goods and makes a collection of a unit (5) of goods comprising one or more pieces of goods (1) possible.

2. Apparatus according to claim 1, characterized in that the means for continuously collecting units (5) of goods comprises two guides (14, 15), endless chains or similar means guided in said guides, one of said chains on predetermined distances carries the said front stop bar (16) which reduces the speed of the goods and provides a collection of units (5) of goods, and the second chain on equally spaced distances carries rear stop bars (17) adapted to contact the rear side of the units (5) of goods.

3. Apparatus according to claim 2, characterized in that the guides (14, 15) for the front stop bars (16) and the rear stop bars (17) are provided aside of the conveyor belt (7) for the package containers (4), and in that the said guides are formed so that the stop bars (16, 17) from a position completely outside the conveyor belt (6) for the units (5) of goods are successively moved in over the said conveyor belt (6) with the front stop bar (16) moved in first and the rear stop bar (17) following and with the two stop bars (16, 17) extending across the said conveyor belt (6) and so that the two stop bars (16, 17) are moved some distance parallelly with the conveyor belt (6) for the units (5) of goods until said units are pushed into the package containers (4), whereupon the two stop bars (16, 17) are moved out from the said conveyor belt (6) and move back to the inlet end (24) of the guides (14, 15).

4. Apparatus for executing the method for packing of unit of goods (5) in so called wrap-around-packages under continuous movement, whereby the package (4) is successively wrapped around the unit of goods and is sealed, characterized in that the apparatus generally comprises means (2) for continuously collecting units (5) of goods to be packed, means (3) for formation of a plain package blank (4) to a package container with one sloped wall, which is completely open at least at one side, means (6, 16, 17, 7, 34, 35) for continuously feeding units (5) of goods and the preformed package containers (4) in a continuous movement with the same speed and side by side, means (8) for pushing each of the units (5) of goods into one package container (4), and means (9) for closing and sealing the package containers (4) which are filled with units (5) of goods further characterized in that the means (3) for preparing a plain package blank (4) to receive a unit (5) of goods comprises a magazine for plane package blanks (4) provided above and aside of the conveyor belt (4) for the prepared package containers (4), means (26) for one by one feeding a package blank to a position above the conveyor belt (7) for the package container (4), a mechanical push down means (28) for pushing the bottom part (4*a*) of the package blank (4) down between formation means (29), whereby at least two opposite sides (4*b*, 4*c*) of the package blank are fold up and one side is sloped from the package bottom (4*a*) and pull-down means (30) acting from underneath and engating the underside of the package bottom (4*a*) to pull the package down onto a table (31) extending on the same level as the conveyor belt (7) for the package container (4).

5. Apparatus according to claim 4 characterized in that a pusher (32) is provided on the table (31) for receiving a pulled-down preformed package container (4) which pusher in a predetermined time relationship pushes a preformed package container (4) out on the conveyor belt (4) for the package containers, so that the said package containers are located exactly aside of and parallelly with the fed units (5) of goods.

6. Apparatus according to claim 4, characterized in that the conveyor belt (7) for the package containers (4) has a number of groups of followers each group consisting of a front and a rear follower (34, 35), with one thereof pivoted in which the said groups of followers are mounted on a distance from each other exactly corresponding to the distance between the front stop bars (16) for the units (5) of goods.

7. Apparatus according to claim 6, characterized in that the front follower (34) is fixed whereas the rear follower is pivoted by being provided rotatable about a cross shaft in the conveyor belt (7), and in that the rear follower (35) slides on a guide curve (36) which brings the said rear follower (35) to rotate somewhat rearwardly thereby opening the latterally extending sides (4*b*, 4*c*) of the package container correspondingly in the position in which the unit (5) of goods is pushed into the package container (4), whereupon the rear follower rotates back and presses the container sides (4*b*, 4*c*) against the unit (5) of goods.

8. Apparatus for executing the method for packing of unit of goods (5) in so called wrap-around-packages under continuous movement, whereby the package (4) is successively wrapped around the unit of goods and is sealed, characterized in that the apparatus generally comprises means (2) for continuously collecting units (5) of goods to be packed, means (3) for formation of a plain package blank (4) to a package container with one sloped wall, which is completely open at least at one side, means (6, 16, 17, 7, 34, 35) for continously feeding units (5) of goods and the preformed package containers (4) in a continuous movement with the same speed and side by side, means (8) for pushing each of the units (5) of goods into one package container (4), and means (9) for closing and sealing the package containers (4) which are filled with units (5) of goods further characterized in that the means (8) for pushing units (5) of goods sideways into a package container (4) comprises a guide (39) carrying an endless chain or similar means which in turn carries a number of pushers (40) provided on exactly predetermined equally spaced distances and located just in front of each unit (5) of goods, whereby the said guide (39) is formed so that the pushers (40) sideways pushes a unit (5) of goods into a package container (4) and thereafter is immediately removed from the package container and from the conveyor belt (6) for the units (5) of goods.

9. Apparatus according to claim 8, characterized in that it comprises means (48, 49, 50) known per se for folding down and attaching the lid (4*i*) of the package container and means (45–48) for folding in and attaching the remaining sides of the package container (4).

10. Apparatus according to claim 9, characterized in that it comprises means (51, 52) for supporting a package container from behind while folding the lid (4*i*) thereof down and attaching same, whereby the two transversally extending sides (4*b*, 4*c*) are pressed to the unit (5) of goods present in the container.

11. Apparatus for packing units of goods in a continuous movement in so called wrap-around packages, which apparatus comprises means for continuously collecting units of goods to be packed, means for preforming a plain package blank to a package container which is put on a feeder for packages with at least one laterally disposed package side fully open, a conveyor for continuously feeding units of goods in a continuous movement side by side and with the same speed as the conveyor for the package containers, means for laterally pushing a unit of goods into each package container and means for closing and sealing the package containers containing the units of goods, characterized in that the conveyor for the package containers has several groups of followers, including in each group a front follower and a rear follower at least one of which is movable in the front and rear direction as considered in the moving direction of the conveyor and before the unit of goods is pushed into the package container is adapted to take a position spaced from the second follower which is larger than the width of the container in the feeding direction, whereby the front side and the rear side of package container are widened in relation to each other considered in the feeding direction, whereas the follower or followers after the unit of goods is pushed into the package container takes a position in which the front and the rear sides of the package container are pressed tightly to the unit of goods.

12. Apparatus according to claim 11, characterized in that the front follower is fixed whereas the rear follower is provided rotatable about a cross shaft of the conveyor and that the rear follower slides on a guide curve which brings the said rear follower to rotate somewhat rearwardly thereby opening the front and the rear sides correspondingly in the position in which the unit of goods is pushed into the package container, whereby the rear follower rotates back and presses the container sides to the unit of goods.

13. Apparatus according to claim 11, characterized in that it comprises means for supporting a package container from behind and at the upper edge of the said package container when a lid thereof is fold down and is secured, whereby the front and the rear sides are pressed to the unit of goods provided in the package also at the upper part of the package container.

14. Apparatus according to claim 11, characterized in that the means for preforming a plain package blank to a package container comprises a magazine for plain package blanks provided above and aside the conveyor for the preformed package containers, means for feeding package blanks one by one to a position above the conveyor for the package containers, a mechanical pusher for pushing the bottom portion of a package blank down between preforming tools whereby the front and the rear side of the package blank as considered in the feeding direction are fold up from the package bottom and a puller acting from underneath which engages the underside of the package bottom and pulls the package down onto a table extending on the same level as the conveyor for the package containers.

15. Apparatus according to claim 14 characterized in that the mechanical pusher is adapted to push the bottom of a container blank about half way down to the receiving table whereas the puller acting from underneath from the said position takes over the function of moving the package blank down and provides the final pulling down of the package blank onto the receiving table.

* * * * *